US006935715B2

(12) United States Patent
Bates et al.

(10) Patent No.: US 6,935,715 B2
(45) Date of Patent: Aug. 30, 2005

(54) METHOD OF INK JET PRINTING WITH IMPROVED END OF PAGE PRINTING

(75) Inventors: John Booth Bates, Harrodsburg, KY (US); Bruce Anthony DeBoard, Lexington, KY (US); Mark Alan Lafferty, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 10/073,491

(22) Filed: Feb. 11, 2002

(65) Prior Publication Data

US 2003/0184609 A1 Oct. 2, 2003

(51) Int. Cl.[7] ..... B41J 29/38; B41J 2/01

(52) U.S. Cl. ..... 347/16; 347/101

(58) Field of Search ..... 347/16, 101, 104, 347/106; B41J 29/38, 2/01, 3/407

(56) References Cited

U.S. PATENT DOCUMENTS

| | | | | |
|---|---|---|---|---|
| 5,192,141 A | | 3/1993 | Chung et al. | 400/56 |
| 5,196,863 A | | 3/1993 | Palmer et al. | 346/76 |
| 5,441,353 A | | 8/1995 | Kim | 400/636.1 |
| 5,442,419 A | | 8/1995 | Masutani | 355/74 |
| 5,555,006 A | | 9/1996 | Cleveland et al. | 347/41 |
| 5,646,667 A | | 7/1997 | Border et al. | 347/4 |
| 5,677,716 A | * | 10/1997 | Cleveland | 347/37 |
| 5,689,294 A | | 11/1997 | Karz et al. | 347/40 |
| 5,923,820 A | | 7/1999 | Cunnagin et al. | 395/108 |
| 5,966,145 A | | 10/1999 | Miura et al. | 347/9 |
| 6,109,745 A | | 8/2000 | Wen | 347/101 |
| 6,139,140 A | | 10/2000 | Rasmussen et al. | 347/104 |
| 6,142,605 A | | 11/2000 | Serra et al. | 347/43 |
| 6,161,914 A | | 12/2000 | Haselby | 347/19 |
| 6,239,817 B1 | | 5/2001 | Meyer | 347/36 |
| 6,241,334 B1 | | 6/2001 | Haselby | 347/19 |
| 6,250,734 B1 | * | 6/2001 | Otsuki | 347/16 |
| 6,352,326 B1 | * | 3/2002 | Maeda | 347/12 |
| 6,357,856 B1 | * | 3/2002 | Otsuki | 347/43 |

* cited by examiner

*Primary Examiner*—Manish Shah
*Assistant Examiner*—Leonard Liang
(74) *Attorney, Agent, or Firm*—Taylor & Aust, P.C.

(57) ABSTRACT

A print medium is printed on with a printhead of an ink jet printer. The print medium is advanced in an advance direction a predetermined amount. The print medium is printed on with the printhead in an area corresponding to the predetermined amount. A determination is made of an end of printable area on the print medium in the advance direction. The print medium is advanced in the advance direction a minimum reliable move amount, dependent upon the end of printable area determination. The minimum reliable move amount is less than the predetermined amount. The print medium is printed on with the printhead in an area corresponding to the minimum reliable move amount.

6 Claims, 2 Drawing Sheets

METHOD OF INK JET PRINTING WITH IMPROVED END OF PAGE PRINTING

BACKGROUND OF THE INVENTION

1. Field of the Invention

The present invention relates to a method of printing with an ink jet printer, and, more particularly, to a method of printing near an end of printable area on a print medium.

2. Description of the Related Art

Ink jet printers typically include a paper feed mechanism that moves a print medium through a print zone. The print zone corresponds to the height of the printhead(s). As the print medium is advanced into the print zone, the printhead prints a section of the page by firing nozzles as the printhead moves across the width of the page. The print medium is advanced a predetermined amount, and then the printhead prints again while moving horizontally across the page. This process of advancing and printing while scanning continues down the entire printable area of the print medium.

Movement of the print medium into the print zone is typically controlled by feed rollers which are positioned prior to the print head. While the print medium is under these feed rollers, the print medium advance is accurately controlled. However, near the end of the printable area (also called an image area) at the bottom of the print medium, the print medium exits these feed rollers and movement through the print zone may not happen at all; or in the case of secondary exit rollers, the advance movement becomes much less accurate. Either of these situations may cause noticeable and objectionable print quality defects if printing continues after the paper has left the control of the feed rollers. While mechanical design improvements can limit the bottom portion of the page which suffers from this advance movement and inaccuracy, it is usually cost prohibitive to completely eliminate via mechanical solutions.

One technique which may be used to improve advance movement and accuracy is a software solution which controls and limits which portion of the printhead is used at the bottom of the page. For example, the printhead may be advanced using the predetermined advance amount until the bottom of the printhead is adjacent the end of the printable area. The printhead is then scanned one or more times adjacent the end of the printable area without advancing the print medium so that the print medium does not leave the control of the feed rollers.

The software solution described above to reduce print defects near the end of printable area may also be utilized during multiple pass printing, such as with known dithering or shingling techniques. Multiple pass printing typically uses different nozzles of a printhead to place ink dots at selected ink dot locations on a raster line over multiple passes or scans of the print head across the print medium. A multiple pass printing technique reduces print defects, such as may be associated with a clogged nozzle or the like, by using different nozzles in different passes of the printhead.

When the software technique described above for stopping advance of the print medium near the end of printable area is used in conjunction with a multiple pass printing technique as also described above, the same nozzles of the printhead are used during the multiple passes of the printhead across the print medium. Thus, the multiple pass printing no longer has the advantage of avoiding print defects associated with a clogged nozzle or the like, and print degradation may occur near the end of the printable area in the region where the print medium is no longer advanced relative to the printhead.

What is needed in the art is a method of printing with an ink jet printer near and end of printable area which minimizes possible print degradation near the end of the printable area.

SUMMARY OF THE INVENTION

The present invention provides a method of ink jet printing near an end of printable area in which the advance of the print medium is limited to a minimum reliable move amount between scans to thereby minimize the area which is subject to print degradation.

The invention comprises, in one form thereof, a method of printing on a print medium with a printhead using an ink jet printer. The print medium is advanced in an advance direction a predetermined amount. The print medium is printed on with the printhead in an area corresponding to the predetermined amount. A determination is made of an end of printable area on the print medium in the advance direction. The print medium is advanced in the advance direction a minimum reliable move amount, dependent upon the end of printable area determination. The minimum reliable move amount is less than the predetermined amount. The print medium is printed on with the printhead in an area corresponding to the minimum reliable move amount.

An advantage of the present invention is that improved end of page printing is provided.

Another advantage is that the advance of the print medium is modified to a minimum reliable move amount near the end of printable area so that the area subject to print degradation is minimized.

Yet another advantage is that the advance of the print medium is modified as the printhead approaches the end of printable area such that the bottom of the printhead aligns with the top of the area in which the advance is minimized.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
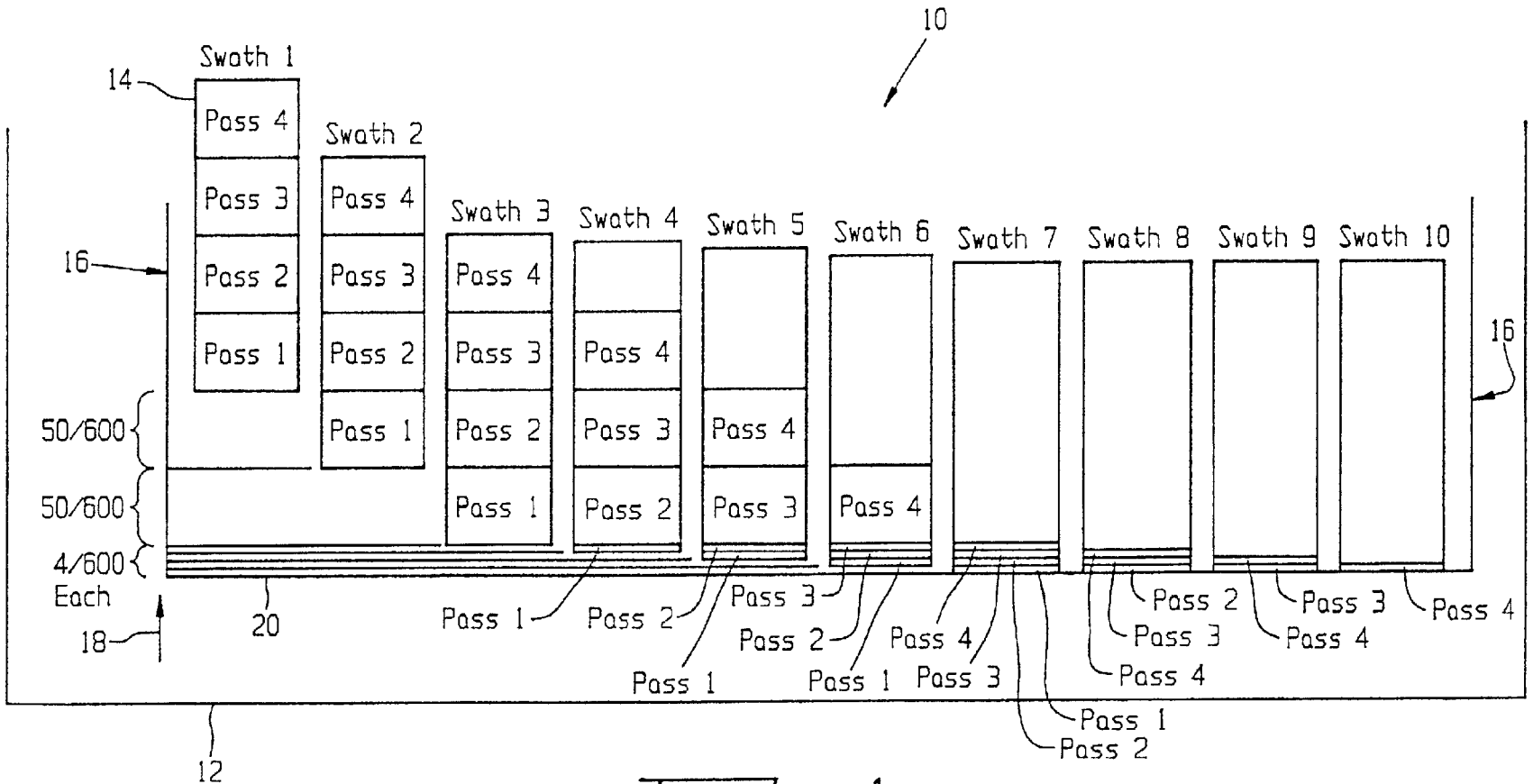
FIG. 1 is a graphical illustration of an embodiment of a method of printing of the present invention.

Referring now to the drawings, and more particularly to FIG. 1, there is shown an embodiment of a method of printing 10 on a print medium 12 using a printhead 14 in an ink jet printer. A preset or user defined printable area 16 overlies print medium 12. This is generally based upon the size of print medium 12, as well as the specified margins surrounding printable area 16. Print medium 12 moves in an advance direction 18 relative to printhead 14 between swaths or scans of printhead 14 across the width of printable area 16. Printable area 16 also includes an end of printable area 20 relative to advance direction 18. As described above, print medium 12 may exit the feed rollers at or near a location in which printhead 14 is adjacent to the end of printable area 20. The present invention provides improved printing near an end of printable area 20, as will be described in more detail hereinafter.

Printhead 14 is scanned across image area 16 using multiple pass printing to improve print quality, such as with a shingling or dithering technique. The number of passes or scans of printhead 14 across printable area 16 typically is an integer divisor of the height of printhead 14. In the embodiment shown, the printing is assumed to be carried out using four pass printing, with each pass corresponding to one fourth the height of printhead 14. Stated another way, print medium 12 is advanced in advanced direction 18 a predetermined amount of one fourth the height of printhead 14 between scans across printable area 16. Defining the height of each pass as a different integer divisor of the height of printhead 14 is also possible (such as two pass printing or three pass printing), with the integer divisor being represented by the variable p.

Since printhead 14 is assumed to be utilized in four pass printing in the example shown, each fifty PEL high group of raster lines is scanned four times by printhead 14. Since the fifty nozzles used for each pass differ from one pass to another, the effect of a clogged nozzle is minimized, thereby minimizing print defects. During each scan, printing occurs within each pass corresponding to the predetermined amount associated with the advance distance of 50/600 inch.

In FIG. 1, ten swaths or scans of printhead 14 are shown as printhead 14 approaches end of printable area 20 on print medium 12. In the example shown, printhead 14 is assumed to include two hundred nozzles which are spaced 1/600 inch apart relative to advance direction 18. Since printhead 14 is utilized with four pass printing in the example shown, each pass has a height relative to advance direction of fifty nozzles, or 50/600 inch.

During printing of swath 1, printhead 14 is scanned across printable area 16 and ink dots are placed at selected locations on print medium 12. Thereafter, print medium 12 is advanced a distance of 50/600 inch, printhead 14 is again scanned across print medium 12 and ink dots are jetted at selected ink dot locations within printable area 16. As printhead 14 approaches end of printable area 20, an area adjacent to end of printable area 20 is reserved for printing multiple pass printing without advancing paper 12 the predetermined distance as shown with the four pass printing of swath 1 and swath 2.

More particularly, because of possible errors associated with the rotation of the feed rollers advancing print medium 12, there is a minimum reliable move amount which print medium 12 must be moved in advance direction 18. In the example shown, the minimum reliable move amount is assumed to be the distance associated with four nozzles or rasters (i.e., 4/600 inch). Printhead 14 is still scanned four times corresponding to the four pass printing which occurred on the remainder of print medium 12; however, the height of each pass in advance direction 18 is limited to the height of the minimum reliable move amount. For the example shown in FIG. 1, the area adjacent end of printable area 20 during which four pass printing occurs is four passes at 4/600 inch per pass or 16/600 inch in total height.

Between swaths 2 and 3, print medium 12 is again advanced a predetermined amount of 50/600 inch. For clarity and ease of illustration, it is assumed that the bottom of printhead 14 aligns with the top of the sixteen PEL high region adjacent the end of printable area 20. Printhead 14 is then scanned during swath 3 across print medium 12 and ink dots are placed at selected ink dot locations within printable area 16. The bottom of printhead 14 is maintained at the top of the 16/600 inch high area at the end of printable area 20.

Between swaths 3 and 4, printhead 14 is only moved the minimum reliable move amount corresponding to four nozzles or 4/600 inch. Pass 1 of swath 4 only utilizes the bottom four nozzles of printhead 14, whereas passes 2, 3 and 4 of swath 4 each utilize the next group of fifty adjacent nozzles. The top forty-six nozzles of printhead 14 are not utilized during swath 4.

Between swaths 4 and 5, print medium 12 is again advanced the minimum reliable move amount of 4/600 inch. As printhead 14 is scanned across print medium 12 during swath 5, pass 1 utilizes the bottom four nozzles, pass 2 utilizes the next 4 vertically adjacent nozzles, and passes 3 and 4 each utilize fifty nozzles.

Between swaths 5 and 6, print medium 12 is again advanced the minimum reliable move amount a distance of 4/600 inch and printhead 14 is scanned across print medium 12. Passes 1, 2 and 3 of swath 6 utilize the bottom twelve nozzles and pass 4 utilizes the vertically adjacent fifty nozzles.

Between swaths 6 and 7, print medium 12 is again advanced a distance of 4/600 inch and the bottom of printhead 14 aligns with the end of printable area 16. Printing occurs on print medium 12 during swath 7 with passes 1–4 utilizing the bottom 16 nozzles of printhead 14.

During printing of swaths 8, 9 and 10, print medium 12 is no longer advanced the minimum reliable move amount of 4/600 inch since the bottom of printhead 14 is already at the end of printable area 20. This helps to ensure that print medium 12 does not leave the reliable control of the feed rollers. During swath 8, printing occurs during passes 2, 3 and 4 of the associated raster lines using the bottom twelve nozzles of printhead 14. During swath 9, passes 3 and 4 of the associated raster lines occurs using the bottom eight nozzles. During swath 10, pass 4 on the bottom four raster lines occurs using the bottom four nozzles of printhead 14. Thereafter, print medium 12 may be transported from the printer.

Figure 2:
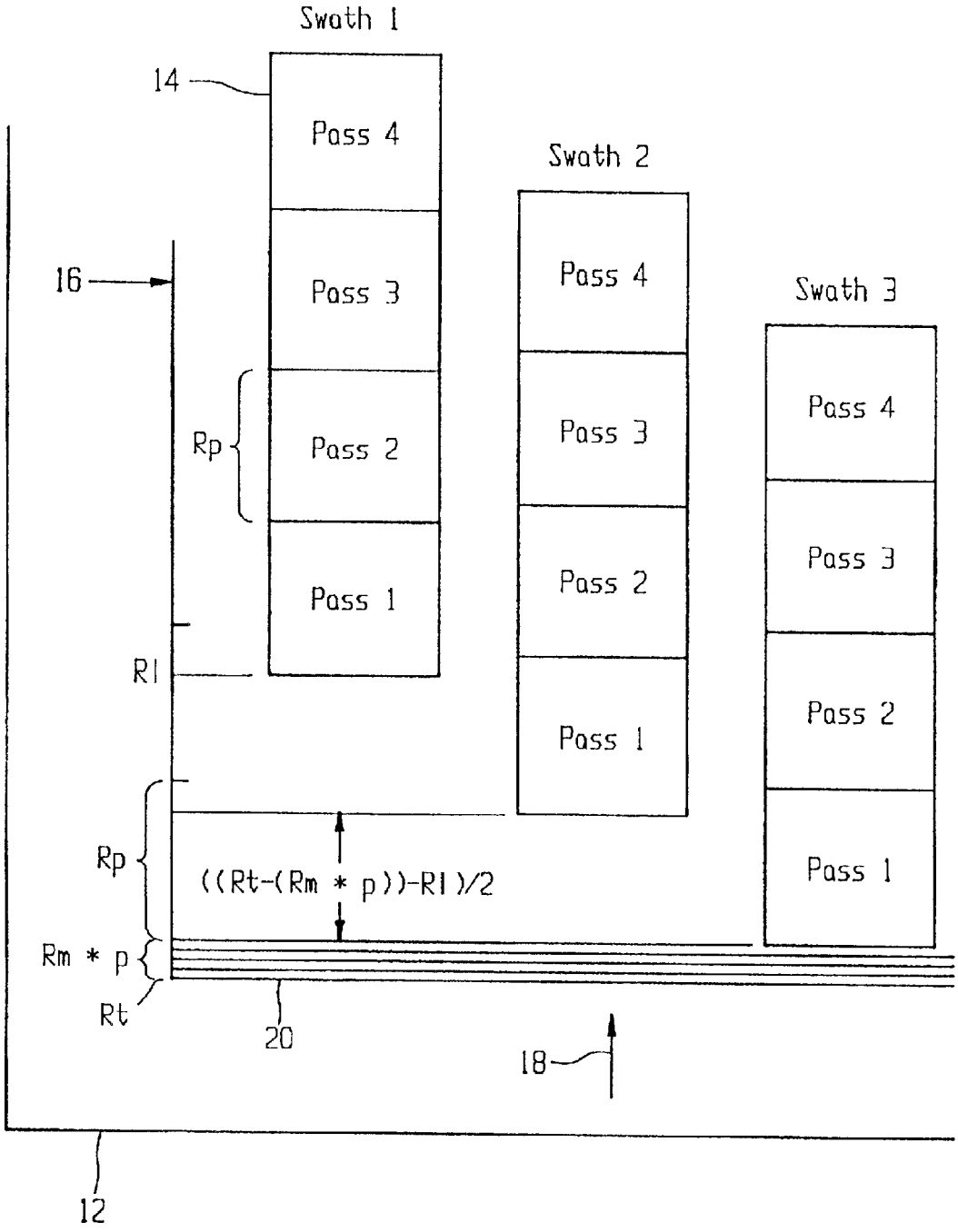
FIG. 2 is a graphical illustration of the modification of the print medium advance as the printhead approaches the end of printable area.

Referring now to FIG. 2, the methodology of determining when printhead 14 is approaching the end of printable area 20 will be described in more detail. As mentioned above, the bottom of printhead 14 is assumed to align with the top of the sixteen PEL high region near the end of printable area 20 for ease of illustration. However, although this may sometimes occur, it is also likely that as printhead 14 is advanced the predetermined amount of 50/600 inch during each scan in the example shown, the bottom of printhead 14 will not align perfectly with the top of the sixteen PEL high region adjacent the end of printable area 20. To that end, if printhead 14 is determined to be within two moves of the sixteen PEL high region adjacent end of printable area 20, then the predetermined amount in the advance direction is reset. This is accomplished in the embodiment shown by calculating whether the following mathematical relationship is true:

$$(Rt-(Rm*p))-Rl \leqq 2*Rp$$

where,

Rt=a total number of raster lines in the printable area;

Rl=a current raster line number associated with the printhead which is closest to the end of printable area;

Rp=a number of raster lines corresponding to the predetermined amount; and

Rm=a number of raster lines corresponding to the minimum reliable move amount.

If this calculation returns a true boolean expression, then printhead 14 is within two moves of the sixteen PEL high area at the end of printable area 20 and the predetermined advance amount for the print medium is reset by dividing the remaining distance to the sixteen PEL high area in half More particularly, the predetermined amount is reset using the mathematical expression:

$$((Rt-(Rm*p))-Rl)/2$$

Thus, the remaining two moves between the last raster line Rl at the bottom of printhead 14 and the top raster line at the bottom of the sixteen PEL area adjacent the end of printable area 20 is divided evenly into two remaining passes of printhead 14. Referring to FIG. 2, the bottom of printhead 14 is advanced one-half the distance to the top of the sixteen PEL region during swath 2, and aligns with the top of the sixteen PEL region in swath 3. If the number of raster lines to be divided in half is an odd number, then one of the two remaining moves will include one more raster line than the other remaining moves. Thereafter, advancing of the print medium and printing within successive scans occurs as described above with reference to swaths 4–10 shown in FIG. 1.

Using the methodology of the present invention as described above, printing is carried out on print medium 12 such that a distance D near the end of printable area 20 subject to print degradation (e.g., as a result of a clogged nozzle, etc.) is represented by the mathematical expression:

$$d=(n-1)*m$$

where, m=minimum reliable move amount; and n=number of passes at bottom of page=p Using the example shown in FIGS. 1 and 2 above, the distance D which is subject to print degradation may be represented by the expression:

$$d = (4-1)*4/600 \text{ inch}$$

$$= 12/600 \text{ inch.}$$

Thus, the area corresponding to the distance D which is subject to print degradation at the end of printable area 20 is minimized using the method of printing of the present invention.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of printing on a print medium with a printhead in an ink jet printer, said printer having a minimum distance the print medium must be moved in an advance direction to overcome advancement errors associated with equipment for advancing the medium, to thereby move the medium a reliable distance, said method of printing comprising the steps of:

advancing the print medium in said advance direction a predetermined amount during a first advancing step;

printing on the print medium with the printhead in an area corresponding to said predetermined amount during a first printing step;

determining an end of printable area on the print medium in said advance direction;

advancing the print medium in said advance direction a fixed minimum reliable move amount during a second advancing step, dependent upon said determining step, said minimum reliable move amount being equal to said minimum distance and less than said predetermined; and printing on the print medium with the printhead in an area corresponding to said minimum reliable move amount during a second printing step;

wherein said first printing step is carried out using multiple pass printing, said multiple being an integer p; and said determining step including:

calculating whether the following mathematical relationship is true:

$$(Rt-(rm*p)-Rl \leqq 2*Rp$$

where,

Rt=a total number of raster lines in said printable area;

Rl=a current raster line number associated with said printhead which is closest to said end of printable area;

Rp=a number of raster lines corresponding to said predetermined amount; and

Rm=a number of raster lines corresponding to said minimum reliable move amount.

2. The method of printing of claim 1, wherein if said calculating step is a true boolean expression, then resetting said predetermined amount to a distance corresponding to ((Rt −(Rm*p))−Rl)/2.

3. The method of printing of claim 2, including the step of repeating said first advancing step and said first printing step two remaining times.

4. The method of printing of claim 2, wherein said multiple pass printing corresponds to four pass printing.

5. A method of printing on a print medium with a printhead in an ink jet printer having a minimum distance, the print medium must be moved in an advance direction to overcome advancement errors associated with equipment in the printer for advancing the medium, to thereby move the medium a reliable distance, said method of printing comprising the steps of:

printing on the print medium using multiple pass printing, including the repetitive substeps of:

advancing the print medium in an advance direction a predetermined amount during a first advancing step; and printing on the print medium with the printhead in an area corresponding to said predetermined amount during a first printing step;

determining an end of printable area on the print medium in said advance direction; and printing on the print medium using adjusted multiple pass printing, dependent upon said determination of said end of printable area, including the repetitive substeps of:

advancing the print medium in said advance direction a fixed minimum reliable move amount during a second advancing step, said minimum reliable move amount being equal to said minimum distance and less than said predetermined amount; and printing on the print medium with the printhead in an area corresponding to said minimum reliable move amount during a second printing step;

wherein said multiple pass printing of said first printing step is carried out with a multiple represented by an integer p; and said determining step including:

calculating whether the following mathematical relationship is true:

$$(Rt-(Rm*p)-Rl \leqq 2*Rp$$

where,

Rt=a total number of raster lines in said printable area;

Rl=a current raster line number associated with said printhead which is closest to said end of printable area;

Rp=a number of raster lines corresponding to said predetermined amount; and

Rm=a number of raster lines corresponding to said minimum reliable move amount.

6. The method of printing of claim 5, wherein if said calculating step is a true boolean expression, then resetting said predetermined amount to a distance corresponding to $$((Rt-(Rm*p))-Rl)/2.$$

* * * * *